US006168536B1

(12) United States Patent
Lovett

(10) Patent No.: US 6,168,536 B1
(45) Date of Patent: Jan. 2, 2001

(54) GOLF CLUB HEAD

(75) Inventor: William E. Lovett, Naples, FL (US)

(73) Assignee: Love it Golf Company, Naples, FL (US)

( * ) Notice: Under 35 U.S.C. 154(b), the term of this patent shall be extended for 0 days.

(21) Appl. No.: 09/001,114

(22) Filed: Dec. 30, 1997

(51) Int. Cl.[7] ..... A63B 53/04; A63B 53/02
(52) U.S. Cl. ..... 473/314; 473/328; 473/350
(58) Field of Search ..... 473/293, 294, 473/305, 313, 314, 324, 350, 316, 328; D21/747

(56) References Cited

U.S. PATENT DOCUMENTS

| | | | |
|---|---|---|---|
| D. 190,035 | * | 4/1961 | Hansen . |
| D. 388,144 | * | 12/1997 | Lukasiewicz . |
| 2,784,969 | | 3/1957 | Brandon . |
| 3,088,736 | | 5/1963 | Mospan . |
| 3,250,536 | * | 5/1966 | Moser . |
| 3,655,188 | | 4/1972 | Solheim . |
| 3,966,210 | | 6/1976 | Rozmus . |
| 4,211,416 | * | 7/1980 | Swanson . |
| 4,754,969 | | 7/1988 | Kobayashi . |
| 4,762,322 | | 8/1988 | Molitor et al. . |
| 4,854,581 | | 8/1989 | Long . |
| 4,874,171 | | 10/1989 | Ezaki . |
| 4,895,367 | | 1/1990 | Kajita . |
| 4,913,435 | | 4/1990 | Kobayaski . |
| 4,986,541 | | 1/1991 | Teramoto . |
| 5,183,255 | | 2/1993 | Antonius . |
| 5,388,826 | | 2/1995 | Sherwood . |
| 5,401,021 | | 3/1995 | Allen . |
| 5,433,439 | | 7/1995 | Hsien . |
| 5,435,559 | | 7/1995 | Swisshelm . |
| 5,480,145 | | 1/1996 | Sherwood . |
| 5,511,780 | | 4/1996 | Vadersen . |
| 5,540,435 | | 7/1996 | Kawasaki . |
| 5,547,426 | | 8/1996 | Wood . |
| 5,607,363 | | 3/1997 | Chou . |
| 5,643,106 | | 7/1997 | Baird . |
| 5,746,666 | | 5/1998 | Lovett . |

FOREIGN PATENT DOCUMENTS

| | | |
|---|---|---|
| 238646 | 5/1962 | (AU) . |
| 787259 | 6/1968 | (CA) . |
| 2194737 | 3/1988 | (GB) . |

OTHER PUBLICATIONS

Photographs of "Salle Hagen—SANDY ANDY" (3) (not dated).

* cited by examiner

*Primary Examiner*—Sebastiano Passaniti
(74) *Attorney, Agent, or Firm*—Oldham & Oldham Co., L.P.A.

(57) ABSTRACT

A golf club wedge having a hosel, a bottom wall, a top surface, a toe, a heel and a striking surface with a lower periphery defined by an arcuate leading edge extending downwardly from the heel to a forwardmost point of the striking surface and extending upwardly from the forwardmost point to the toe. The club further incorporates a leading edge which is significantly forward of the center line of the hosel (forward face progression) to improve playability from difficult lies of a golf ball.

12 Claims, 2 Drawing Sheets

GOLF CLUB HEAD

BACKGROUND OF THE INVENTION

1. Technical Field

The present invention relates generally to improving the playability of golf clubs from difficult lies and more particularly to a golf club head arrangement which effectively minimizes the interference of grasses and other impediments at impact.

2. Description of Related Art

The game of golf has always included an element of accuracy. Golf courses are designed to reward accuracy and to punish, often severely, inaccuracy. A golfer who strays from the fairway or green will find punishment in the way of long grasses of varying type and other impediments which may adversely effect the chances of making contact with the golf ball on the next stroke. For example, the long grass of the rough may interfere with the golfer's stoke by coming between the club head and the ball at impact. The effects of such interference include difficulty in predicting the distance and/or the direction of the golf shot. One particular problem occurs when the long grass of the rough interferes with the club head just prior to impact which causes the club head to unintentionally open or close and results in a wayward shot often of little distance.

A number of techniques have been developed for golfers to improve club head contact with the ball during shots hit from difficult lies. Typically a golfer will make one or more adjustments to his normal swing so as to strike the ball as cleanly as possible thereby minimizing any interference. Golfers are taught to grip the club more tightly when playing shots from the rough and to play the ball in a rearward position in their stance so as to make a golf swing with a more pronounced, upright swing plane as that occurring in their normal golf swing. With these swing modifications the club head approaches the ball at a steep angle and avoids the grass or other impediment immediately behind the ball which would otherwise interfere with impact. As a general rule, it requires a greater amount of strength to hit a golf ball solidly from the rough than from the fairway, especially in high rough, since the extra power is needed to drive the club face through the grass. Consequently, many woman and senior golfers have difficulty advancing the ball from the rough.

As an alternative to altering the golf swing, a golfer may take advantage of a variety of golf clubs developed to aid the golfer in hitting shots from the rough. Many of these golf clubs include a ridge or other extension running along the sole of the club head which drives through the grass in a digging fashion so that better club face-ball contact can be made. Other clubs designed to improve playability from the rough include steeply lofted wood-type clubs with extra long shafts which make use of the steep loft angle and lengthened shaft to allow the golfer to dig the ball out of the rough with added power.

Extremely difficult lies often leave a golfer with no choice but to advance the ball a short distance back into the fairway with a wedge. A wedge is characterized as having a short shaft and a club face with a large loft angle relative to the irons and woods which comprise the balance of the set of golf clubs. Wedges are generally used for short golf shots which require greater accuracy of distance and trajectory and are typically referred to as pitching, sand and lob wedges.

The club head of a conventional wedge includes a hosel which is substantially in line with the leading edge of the clubface, although to a lesser extent wedges are known which are "offset" having the leading edge of the clubface rearward the hosel with respect to the target line. Rarely have club heads been designed which include forward face progression, one example being that embodied in U.S. Pat. No. 5,183,255 to Antonius. The leading edge of wedges and other clubs are typically substantially straight and perpendicular to the target line. Although some degree of curvature in the leading edge is known, it is usually only slight and not intended to improve the playability of the club head from difficult lies.

Most wedges are a part of a matching set of irons and have the same hosel and sole arrangement as the set, however speciality wedges with unique club head features are known. Speciality wedge designs have relied primarily on unique loft and lie angles to achieve novel trajectories during ball flight including flight from tight lies in long grass. In the recent past, golfers have begun to carry a number of specialty wedges designed for specific playing situations.

While currently existing specialty wedges are designed to allow the golfer to obtain higher trajectory and improved accuracy from both fairway and difficult lies, these wedges have not dramatically increased playability from the rough and remain dependent, at least in part, on the golfers ability to modify his stroke to strike the ball from the rough. There remains a great need for an improved wedge design capable of allowing a golfer to make clean contact from the rough and/or sand independent of the golfers ability or intention of modifying his swing.

SUMMARY OF THE INVENTION

The present invention provides a golf club head having a hosel, a bottom wall, a top surface, a toe, a heel and a striking surface having a periphery defined by an arcuate leading edge extending downwardly from the heel to a forwardmost point of the striking surface and extending upwardly from the forwardmost point to the toe, the periphery being further defined by an upper edge extending from the hosel to the toe across the top of the striking surface. The centerline of the hosel intersects a plane containing the striking surface at a point rearward the leading edge.

The golf club head in accordance with the present invention makes use of a leading edge and sole design together with a forward face progression arrangement uniquely designed to improve playability from difficult lies such as those found in the rough or in a hazard. This unique arrangement plows through the impediments in the hazard and imparts a wave-like action to the grass or sand immediately behind the ball effectively minimizing interference with club head-ball impact. The preferred embodiment may be characterized as combining the advantages associated with forward face progression with those accompanying an arcuate leading edge and sole design capable of effectively eliminating interfering impediments.

It is therefore an object of the present invention to provide a golf club head capable of improving club face-ball contact for golf shots struck from difficult lies by providing a combination of club head features designed to minimize the effect of otherwise interfering grasses or sand. The club head of the present invention accomplishes this objective through the combination of forward face progression and a leading edge and sole design. Whereas the forward face progression element is designed to place the center of gravity of the club head rearward the leading edge and improve the likelihood of striking the ball without interference from the hosel, the curved leading edge element minimizes the interference of long grasses and other impediments by creating a wave-like action through the grass or sand. The sole is design to effectively eliminate a portion of the sand through which the club head must travel during a bunker shot. This combination of club head features improves playability from difficult lies by minimizing the effect of interfering grasses and other impediments which would interfere with impact.

The above and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
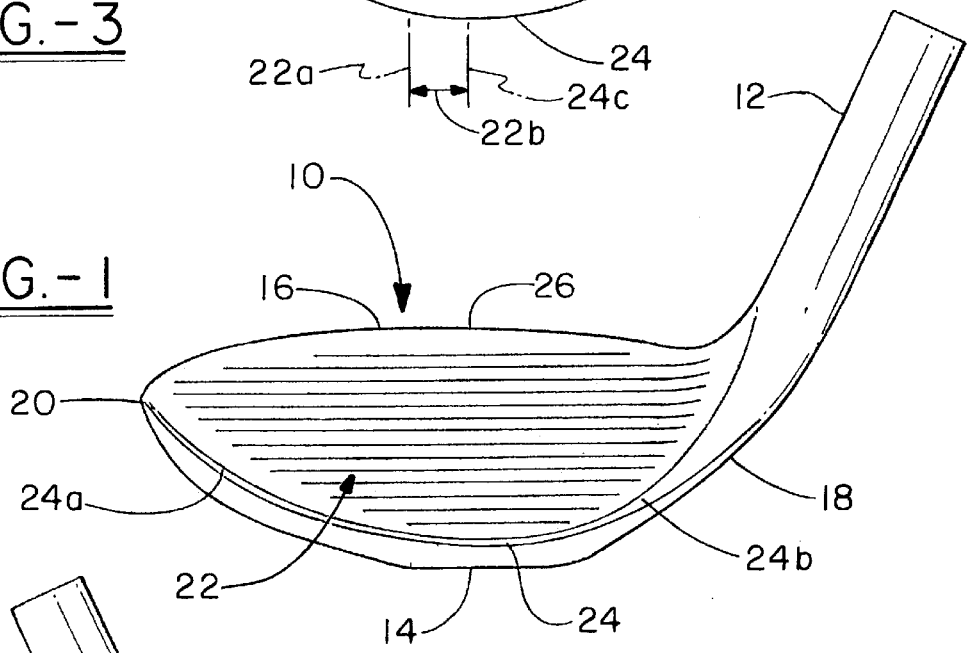
FIG. 1 is a front elevational view of the club head in accordance with the present invention.

Referring now to the drawings, a golf club head (10), in accordance with a preferred embodiment of the present invention, is shown. The club head (10) is in a configuration similar to that of a "wedge", and is preferably made of cast or forged metal although other materials including composites are certainly within the contemplation of the inventor. The club head (10) as shown in FIG. 1 has a hosel (12), a bottom wall or sole (14), a top surface (16), one end portion proximate the hosel commonly termed the heel (18), an end portion opposite the heel termed the toe (20), and a ball striking surface or face (22). The lower boundary of ball striking surface (22) is defined by arcuate leading edge (24) extending from heel (18) to toe (20). The upper boundary of ball striking surface (22) is defined by upper edge (26) which is rearward of the hosel and extends from the hosel (12) to toe (20).

Figure 2:
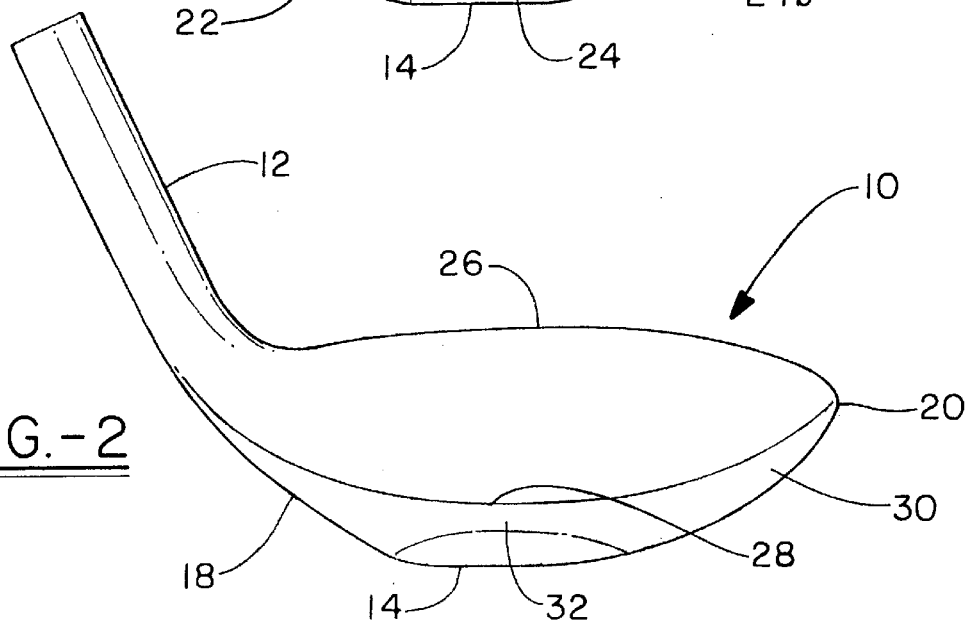
FIG. 2 is a rear elevational view of the club head illustrated in FIG. 1.

Referring now to FIG. 2, the back surface (16) of club head (10) is moderately convex and shown extending from upper edge (26) to back edge (28) which defines the rearward most edge of the club head (10). Back edge (28) extends from hosel (12) and heel portion (18) to toe (20) in a generally convex arc. FIG. 2 shows back edge (28) extending from hosel (12) downwardly and across the back of the club to a lower most point before again rising to meet upper edge (26) at toe (20). Back edge (28) defines the lower and rear boundaries of back surface (16) as well as the upper and rearward boundaries of bottom wall or sole (14).

Figure 3:
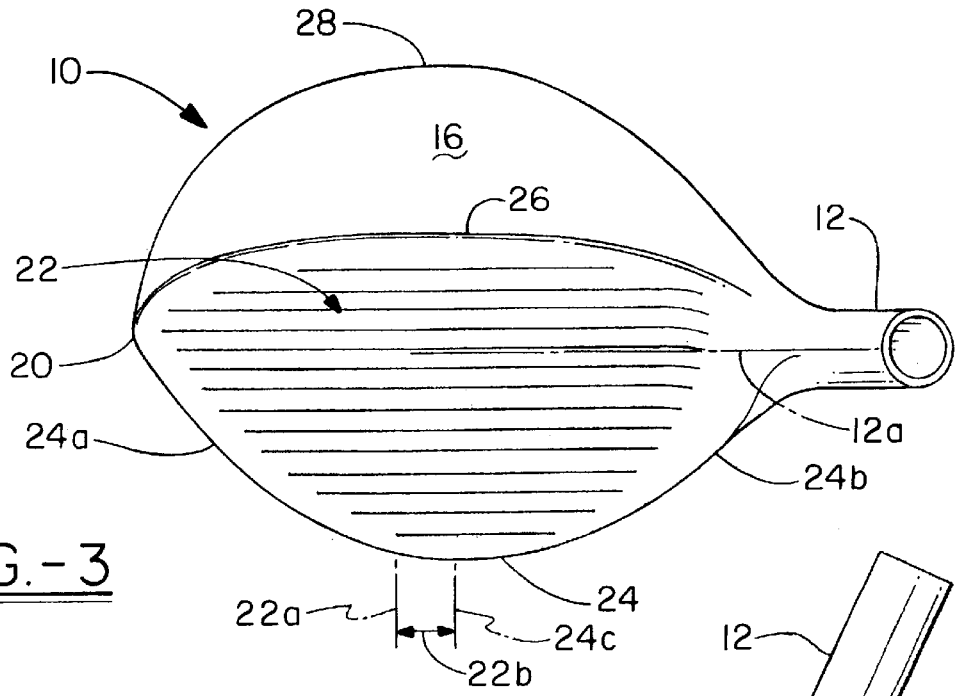
FIG. 3 is a top view of the club head illustrated in FIGS. 1 and 2.
Figure 4:
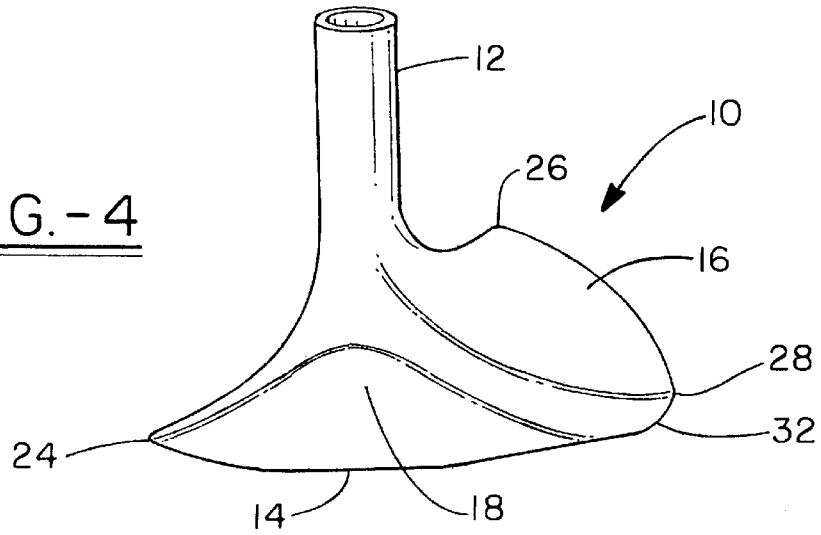
FIG. 4 is a heel or right end elevational view of the club head illustrated in FIGS. 1 through 3.
Figure 5:
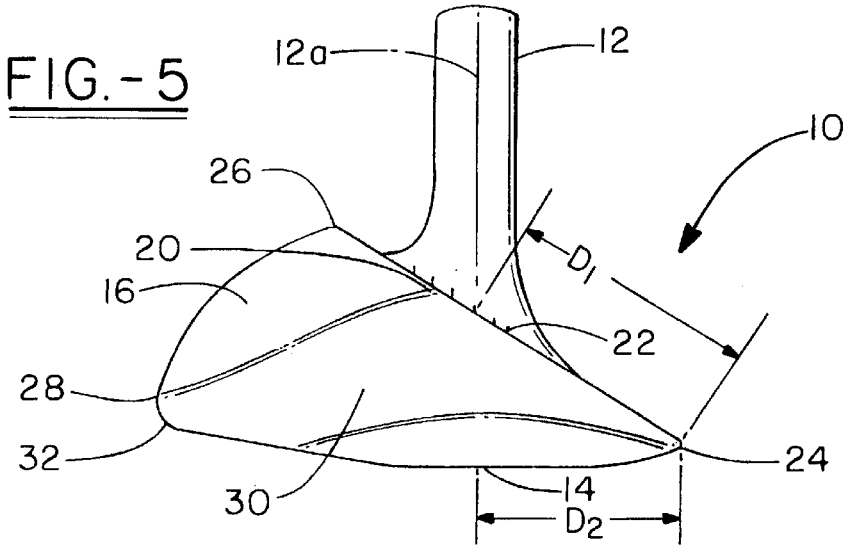
FIG. 5 is a toe or left end elevational view of the club head illustrated in FIGS. 1 through 4.
Figure 6:
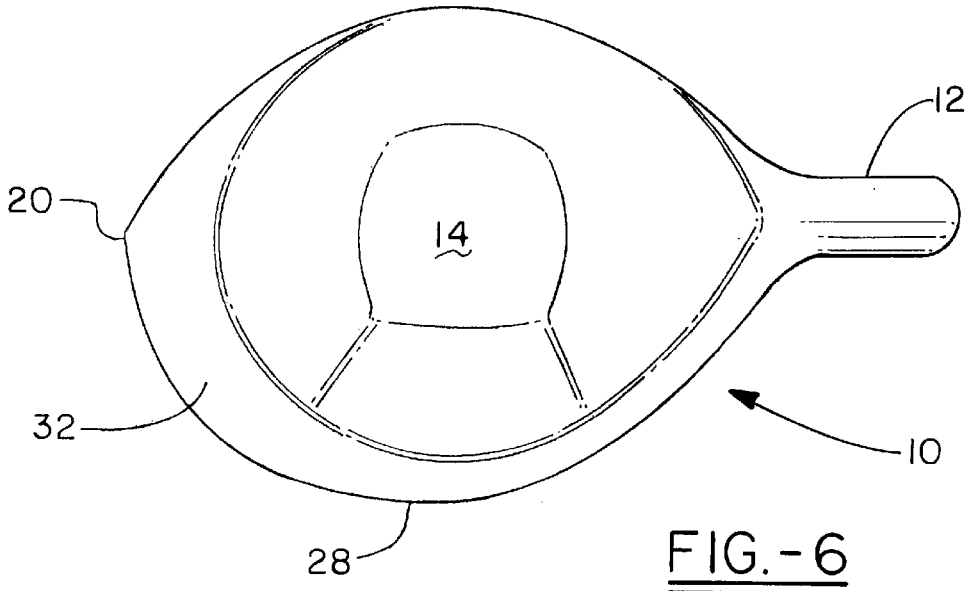
FIG. 6 is a bottom view of the club head illustrated in FIGS. 1 through 5.

Referring now to FIGS. 3 through 5, and in particular to the forward face progression aspect of this invention. The term forward face progression refers generally to those golf club heads having a leading edge forward the center line of the hosel in relation to the target line or a line perpendicular to the face (22) of the club. Forward face progression in club head (10) can be seen in FIGS. 3 through 6 which shows the placement of hosel (12) substantially rearward of leading edge (24) and intersecting club head (10) behind the vertical center of ball striking surface (22). The distance from leading edge (24) to the intersection of the center line **(12*a*) of hosel (12) with striking surface (22) can be measured along ball striking surface (22), $D_1$, or along a line in a plane which includes the target line or centerpiece (22*a*) of face surface (22), $D_2$, these two distances being related by the loft angle (typically between about 48° and about 64°) of club head (10). The distance along ball striking surface (22), $D_1$, in the preferred embodiment is approximately 3.5 cm, but can vary from about 2.75 cm to 5.7 cm and still meet the objects of the invention. The distance along sole (14)**, $D_2$, is approximately 2.8 cm but can vary from about 2.2 cm to about 3.4 cm and still meet the objects of the invention.

The design of a conventional golf club iron has been that the leading edge of the face of the club, or edge (24) in FIGS. 4 and 5, is about in line with the centerline of the hosel **(12*a*). Some irons may have forward face progression of 0.3 to 0.6 cm, but typically not much more than 0.6 cm. It is typical of fairway woods that there be slight forward face progression in the range of 0.6 to 1.0 cm. Thus, the design of the present invention, a wedge with forward face progression preferably exceeding one inch, is a major change from the typical wedge design. It is this major extension of the face progression to the ranges presented above and shown in FIG. 5** that contributes significantly to the improved hitting characteristics of the club.

Forward face progression has the effect of maintaining the leading edge of the club head forward the player's hands at impact. With conventional golf clubs, i.e. those in which the leading edge extends from the hosel in a way which does not create a significant forward or rearward face progression, the golfer's hands must be kept forward of the leading edge at impact to make proper contact with the ball. As best shown in FIG. 5 the intersection of the center line **(12*a*) of hosel (12) with club head (10) is rearward the leading edge (24) and substantially near the center of club head (10)** with respect to the target line. Forward face progression eliminates the general requirement of keeping the hands forward of the club face at impact and allows the golfer to play the golf ball in the center of his stance with his hands over the striking face at impact. This arrangement maintains the leading edge forward the hosel at all times and allows the golfer to make contact with the leading edge without having the hosel interfere with or come in contact with any impediments in the impact zone.

Forward face progression has the further effect of placing the center of gravity of the club rearward the leading edge. The center of gravity is positioned along hosel centerline **(12*a*) near the intersection of the centerline (12*a*) with striking surface (22) at about the center point of the leading edge (24) as depicted by line (24*c*). Preferably, the center of gravity is displaced approximately 0.5 cm from centerline (24*c*) toward hosel (12), although the objectives of the invention can be met by a displacement of up to 1.5 cm from centerline (24*c*) toward either hosel (12) or toe (20). With the center of gravity substantially in line with the hosel center line (12*a*), the leading edge passes through the impact point prior to the center of gravity. This delay allows the ball to maintain contact with striking surface (22) for a brief period, moving along striking surface (22)**, before experiencing the mass of the club. The result is a higher shot than is possible with a conventional wedge.

The present design includes a sole (14) arrangement which improves the playability of the club from bunkers. As shown in FIGS. 4 and 5, the sole (14) of the club head (10) rises toward back edge (28) rearward the hosel (12) making the transition from sole (14) into back edge (28) through transitional surface (32). Allowing the rear portion of the sole (14) to sweep upwardly effectively eliminates that portion of the sole which would otherwise move down and through the sand. The result is a club head which rides up and through the sand having to displace less sand during a bunker shot. In this way the sole design effectively removes sand which would otherwise interfere with the shot allowing the golfer to displace less sand while playing a difficult long bunker shot. By eliminating a portion of the sand through which the club head travels, the present invention improves the player's control over distance and accuracy.

Another aspect of the present design is the significantly curved leading edge (24) of the surface (22). This curved edge which extends from about point (24*a*) to (24*b*), as best shown in FIG. 3, acts to split the grass behind the ball when in the rough or hazard so that the likelihood of grass or other impediments between the club face and the golf ball at impact is greatly diminished. Typically the arcuate leading edge from points (24*a*) to (24*b*) will extend a distance of between about 5 to 7.5 cm and will be a curvatious edge based upon a radius generally between about 2.5 to 3.8 cm. The edge (24) between points (24*a*) and (24*b*) preferably includes some degree of asymmetry, the curved edge (24) having a slightly more abrupt sweep toward the heel (18) and a slightly lesser abrupt sweep toward the toe (20). Preferably, the curve is substantially symmetric near the forwardmost point of the leading edge (24), and becomes asymmetric at a distance of about 1.25 cm to both sides of the most forward point of (24) where it begins to blend into the more abrupt curve toward (24*b*) and a less abrupt curve toward (24*a*). The preferred positioning of the forwardmost point of (24) is displaced relative to the geometric center of the face (22) by about 0.16 to 1.0 cm. This is depicted by the face (22) centerline (22*a*) shown in FIG. 3 and the spacing between the centerline (22*a*) and the center point of the leading edge (24) as depicted by spacing (22*b*). It is believed that the line (24*c*) and (22*a*) could coincide without the club losing its functionality, however when line (24*c*) is moved closer to the toe (20) than line (22*a*) the balance and functionality of the club may diminish.

FIG. 1 and 3 show the leading edge (24) of club head (10) and in particular the arcuate periphery of striking surface (22). Unlike conventional golf clubs, in which the leading edge is substantially perpendicular to the target line, the leading edge of club head (10) is arcuate with only the tangent to the forward most point being perpendicular to the target line. The arcuate nature of leading edge (24) effectively removes the leading edge at the toe (20) and heel (18) portions of the face from the impact zone. In this way the leading edge at the toe (20) and heel (18) are rearward the ball at impact. The radius of curvature of leading edge (24) will depend upon the degree of forward face progression and the loft of the club head, but has been generally described with general dimensional parameters above.

The effect of combining forward face progression with the leading edge and sole design of the present invention is to impart a wave like action to the grasses, sand and other impediments which would otherwise interfere with impact. The arcuate leading edge arrangement minimizes interference from grass at the toe (20) and heel (18) portions of the leading edge (24) during impact by plowing or furrowing through the grass. Club head (10) is designated so that the forward most point of leading edge (24) contacts the ball with minimum interference from long grass or sand and eliminates the need to make a pronounced steeply descending swing. The arcuate leading edge (24) cooperates with the forward face progession by minimizing the club head resistance to sand or grass in much the same way as the hull of a boat advances through water or the blade of plow moves through a field. The combination of forward face progression with the leading edge and sole design of the present invention improves the playability of club head (10) from difficult lies minimizing interference with the grass or other impediments and maximizing clean, effective contact between the club face and ball. By effectively removing the grass in this way, the golfer need not make a more powerful swing than normal. Those golfers have difficulty making a swing powerful enough to advance the ball from heavy rough will find the club head of the present invention particularly helpful.

While the above description has been presented with specific relation to a particular embodiment of the invention and use of the club head in difficult lies, it is to be understood that the club head of the claimed invention is not to be limited thereby. It will thus be seen that the objects set forth above, among those made apparent from the preceding description, are obtained. Certain changes may be made in the club head without departing from the scope of the invention and the above description is intended to be interpted as illustrative and not limiting. It is to be further understood that the present invention relates to the features of the club head and is not limited by the presence of other conventional golf club features. In particular, although the prefered embodiment of the present invention includes the use of a hosel for connecting the club head to a shaft, it is also contemplated that other equivalent shaft-connecting features which may be termed hosel-less are within the scope of the invention.

What is claimed is:

1. A golf club head having a hosel for accepting a shaft, a bottom wall, a top surface, a heel, and a toe and further comprising:

a striking surface defined by an arcuate leading edge extending downwardly from said heel to a forwardmost point and extending upwardly from said forwardmost point to said toe, and an upper edge separating said striking surface from said top surface; and wherein said hosel has a centerline which intersects a plane containing said striking surface at a point rearward said forwardmost point of said leading edge, and said bottom wall includes an upwardly extending surface rearward said centerline, said surface extending toward a back edge of said club head, and said upwardly extending surface and said back edge are connected through a transitional surface, said transitional surface extending from said toe to said heel along said back edge.

2. A golf club head having a hosel for accepting a shaft, a bottom wall, a top surface, a heel, and a toe and further comprising:

a striking surface having an arcuate leading edge extending downwardly from said heel to a forwardmost point and extending upwardly from said forwardmost point to said toe, and an upper edge separating said striking surface from said top surface; and wherein said hosel has a centerline which intersects a plane containing said striking surface at a point rearward said forwardmost point of said leading edge, and said centerline intersects said plane at a point substantially at the center of gravity of said club head.

3. A golf club head comprising:

a hosel, a bottom wall, a top surface, a heel, a toe, and a striking surface having a leading edge extending in a continuous arc from said heel to said toe and having a forwardmost point such that said heel and said toe are rearward said forwardmost point of said leading edge, at least a substantial portion of said leading edge being forward of said hosel; and wherein said continuous arc comprises a first radius of curvature near said heel and a second radius of curvature near said toe, said first radius of curvature being less than said second radius of curvature.

4. A golf club head comprising:

a hosel, a bottom wall, a top surface, a heel, a toe, and a striking surface having a leading edge, at least a substantial portion of which is forward said hosel;

wherein said hosel has a centerline which intersects a plane containing said striking surface rearward the vertical center of said striking surface, and said centerline intersects said plane at a point substantially at the center of gravity of said club head.

5. A golf club head as recited in claim 4 wherein said leading edge extends in a continuous arc from said heel to said toe and having a forwardmost point such that said heel and said toe are rearward said forwardmost point of said leading edge at impact.

6. The golf club head described in claim 5, wherein the distance from said forwardmost point of said leading edge to said intersection of said centerline with said plane is at least about 2.75 cm.

7. The golf club head described in claim 5, wherein said leading edge at said heel and said toe is rearward a golf ball at impact.

8. A golf club head having a bottom wall, a top surface, a heel, a toe and means for accepting a shaft, said club head comprising:

a striking surface having an arcuate leading edge extending downwardly from said heel to a forwardmost point and extending upwardly from said forwardmost point to said toe, and an upper edge separating said striking surface from said top surface;

wherein said means for accepting a shaft has a centerline which intersects a plane containing said striking surface at a point rearward said forwardmost point of said leading edge, and said intersection of the centerline and said plane is rearward the vertical center of said striking surface.

9. The golf club head described in claim 8, wherein the shortest distance from said forwardmost point of said leading edge to said intersection of said centerline with said plane is approximately 3.5 cm.

10. The golf club head described in claim 8, wherein said centerline intersects said plane at a point substantially at the center of gravity of said club head.

11. A golf club head as recited in claim 8 wherein said means for accepting a shaft comprises a hosel.

12. A golf club head comprising:

a hosel, a bottom wall, a top surface, a heel, a toe, and a striking surface having a leading edge, a substantial portion of said leading edge being forward said hosel;

wherein said hosel has a centerline which intersects a plane containing said striking surface rearward the vertical center of said striking surface, and wherein further said leading edge extends in a continuous arc from said heel to said toe so that said heel and said toe are rearward a forwardmost point of said leading edge at impact.

* * * * *